United States Patent [19]

Gonzalez

[11] Patent Number: 4,506,271

[45] Date of Patent: Mar. 19, 1985

[54] PORTABLE ANTENNA WITH WEDGE-SHAPED REFLECTIVE PANELS

[76] Inventor: Brian L. Gonzalez, 16033 Arminta St., Van Nuys, Calif. 91406

[21] Appl. No.: 424,005

[22] Filed: Sep. 27, 1982

[51] Int. Cl.[3] ..... H01Q 1/08

[52] U.S. Cl. ..... 343/915; 343/916

[58] Field of Search ..... 343/915, 912, 878

[56] References Cited

U.S. PATENT DOCUMENTS

| | | | |
|---|---|---|---|
| 2,298,880 | 7/1942 | Gartenmeister | 343/915 |
| 3,383,692 | 5/1968 | Laibson et al. | 343/915 |
| 3,680,144 | 7/1972 | Low et al. | 343/915 |
| 3,832,717 | 8/1974 | Taggart, Jr. | 343/915 |

*Primary Examiner*—Eli Lieberman

*Assistant Examiner*—K. Ohralik

*Attorney, Agent, or Firm*—Roger A. Marrs

[57] ABSTRACT

A portable antenna is disclosed herein having a pedestal supporting on octagon frame via a universal mounting mechanism. A parabolic reflecting antenna is fixed onto a plurality of mounting sockets on the frame and includes a plurality of individual and separate wedge-shaped panels adapted to be assembled in a side-by-side relationship to provide a unitary construction. Each panel includes outwardly projecting flanges on its opposite edge marginal regions cooperating with similar flanges on adjacent panels to define a combined mounting flange to be insertably aligned with and received into the mounting sockets carried on the frame. Fasteners secure the flanges and sockets together in a fixed relationship.

1 Claim, 6 Drawing Figures

PORTABLE ANTENNA WITH WEDGE-SHAPED REFLECTIVE PANELS

BACKGROUND OF THE INVENTION

1. Field of the Invention

The present invention relates to parabolic antennas and more particularly to a novel antenna which is portable and may be readily assembled in situ without skilled workers and without special tools.

2. Brief Description of the Prior Art

In the past, it has been the conventional practice to fabricate the dish-like reflector for a parabolic antenna in a single structure which is subsequently assembled with an articulating base either at the site of usage or at the place of manufacture and shipped as a completed assembly. Either of these procedures have raised many difficulties and disadvantages which stem largely from the fact that the size and weight of the dish-like reflector is large and heavy and cannot readily be assembled with the articulating base at the site of usage without skilled personnel and special equipment. When assembling the reflector at the construction site or factory, the total unit is difficult to transport and cost of transportation is expensive.

In an effort to solve these problems, it is the current practice to fabricate the reflector in a multiplicity of parts which may be readily assembled at a later time with the base at the site of usage. In this manner, the reflector may be easily shipped in smaller sections and each section can be handled and manipulated by unskilled assemblers. However, problems and difficulties have been encountered when assembling the plurality of sections into a completed reflector which stem largely from the fact that not only must the total reflector be firmly attached to the support but the reflector requires minute tuning in order to achieve maximum efficiency. During the tuning procedure, the reflector is moved on the base until the desired transmission of radio wave reception has been achieved. Prior mounting arrangements for the reflector sections do not permit adequate tuning for the entire reflector and suitable mounting attachments for the individual sections in the reflector are cumbersome and awkward so that assembly is difficult.

Therefore, a long standing need has existed to provide an inexpensive parabolic antenna which is composed of a plurality of individual reflector sections that are readily and easily mounted on a supporting frame whereby tuning of the assembled reflector may be readily achieved.

SUMMARY OF THE INVENTION

Accordingly, the above problems and difficulties are obviated by the present invention which provides a novel portable antenna permitting a parabola dish or reflector to be fastened onto a frame in a direct procedure which comprises a pedestal base supporting an octagon frame via a universal mounting means. A parabolic reflecting antenna or dish is fixed onto a plurality of mounting sockets carried in fixed spaced apart relationship about the frame. The reflecting antenna or dish includes a plurality of individual and separate wedge-shaped panels adapted to be assembled in a side-by-side relationship so as to provide a unitary construction. Each panel includes outwardly projecting flanges carried on the edge modular regions and the flanges cooperate with similar flanges on adjacent panels to define a combined mounting flange insertably aligned and received into mounting sockets carried on the frame. Fastener means secure the flanges and sockets together in a fixed detachable relationship.

Adjustment means are included in the construction and assembly of the antenna whereby the pedestal mounting includes a pivot mount for the octagon frame and limit stops for controlling the amount of pivotal adjustment.

Therefore, it is among the primary objects of the present invention to provide a novel portable antenna which may be readily constructed in situ incorporating a plurality of double brackets adapted to receive edge marginal flanges from a plurality of reflector or dish segments or sections adapted to be bolted together on a ground surface upside down.

Another object of the present invention is to provide a novel portable antenna which may be readily assembled on the ground surface in situ by unskilled persons without employing special tools.

Still a further object of the present invention is to provide an inexpensive and portable parabolic antenna which may be readily shipped or transported in sections and may be readily assembled at the using site by joining the sections together.

Yet another object of the present invention is to provide a novel portable antenna having a parabolic reflector composed of a plurality of wedge-shaped panels or sections which are readily mounted on a frame and incorporated onto a pedestal whereby adequate tuning and adjustment may be made for optimum efficiency.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
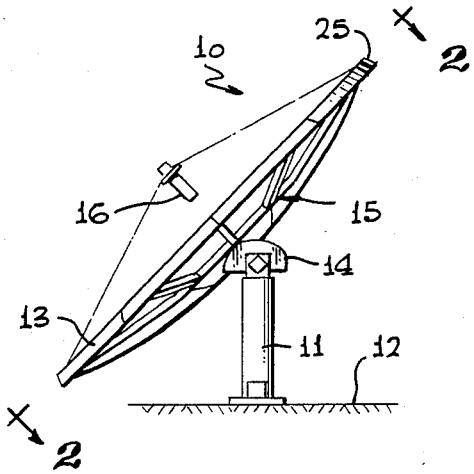
FIG. 1 is a side elevational view of the novel antenna incorporating the present invention.

Referring to FIG. 1, the novel portable antenna of the present invention is indicated in the general direction of arrow 10 which includes a pedestal base 11 supported on a ground surface 12 and which includes a circular, dish-like reflector 13 supported on the pedestal base 11 by a universal movement or adjusting mechanism broadly indicated by numeral 14. Situated between the dish reflector 13 and the adjusting mechanism 14 is a frame 15 which supports the dish reflector thereon. An energy transmitter and wave guide device is broadly indicated by numeral 16 which is supported on the reflector but does not form a part of the present invention.

Figure 2:
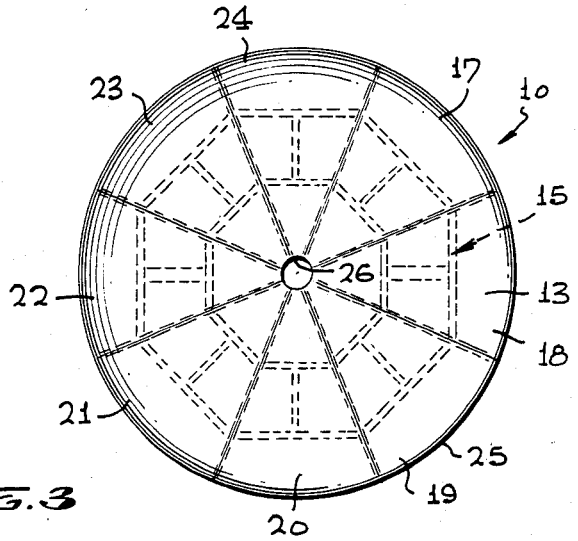
FIG. 2 is a top plan view of the portable antenna shown in FIG. 1 as taken in the direction of arrows 2—2 thereof.

Referring in detail to FIG. 2, it can be seen that the reflector 13 includes a plurality of wedge-shaped panels or sections indicated by numerals 17–24 inclusive. The plurality of panels or sections are arranged so that when adjacent edges are joined, the dish-like structure constituting the reflector is defined having a circular outer edge 25 coaxially disposed with respect to an inner circular edge 26.

Also, it can be seen that the frame 15 takes the form of an octagon in plan view and that the center of the octagon lies on a common axis with the central axis of the circles 25 and 26 respectively.

Figure 3:
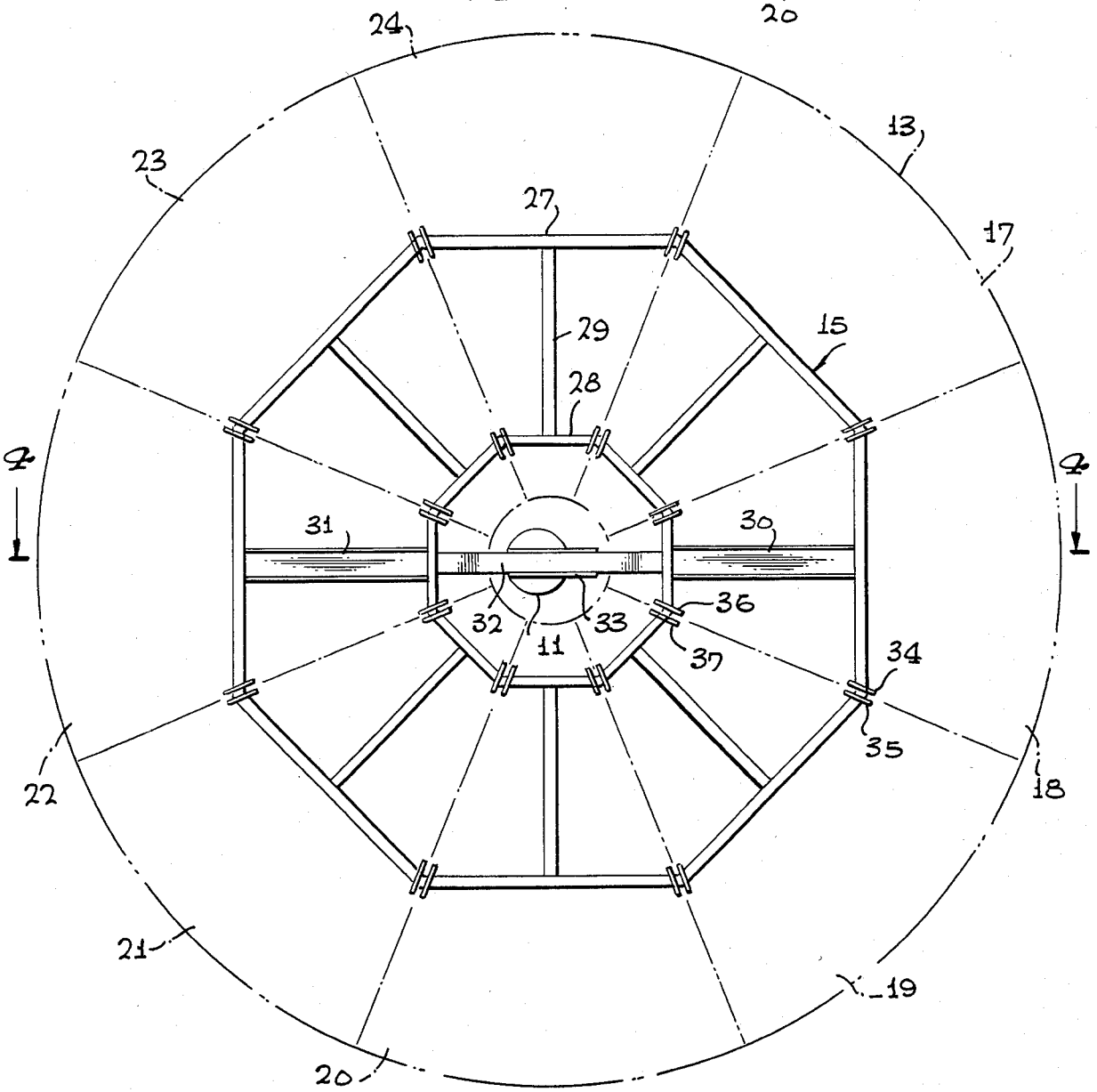
FIG. 3 is an enlarged plan view of the mounting frame used in the portable antenna in FIGS. 1 and 2.

Referring now in detail to FIG. 3, it can be seen that the frame 15 includes an outer rim of adjoining rails such as rail 27 joined to an arrangement of inner rails such as rail 28 by means of a plurality of braces, such as brace 29 arranged normal to the rails 27 and 28. In this fashion, a composite support frame is provided wherein the various rails of the inner and outer rims are parallel to one another and each of the inner and outer rims are joined by a brace member such as brace member 29. However, it is to be noted that a selected pair of inner and outer rims are joined by a channel 30 and 31 which corresponds or constitutes a brace between the respective rails of the rims. The channels are employed for attachment to a cross bar 32 carried on a shoe 33 which is attached to the pedestal base 11.

It is important to note that the junction of the opposite ends of the respective rails constituting the inner and outer rim are provided with a pair of flanges, such as identified by numerals 34 and 35, that are arranged in fixed spaced apart relationships so as to define a mounting socket. Flanges 34 and 35 are associated with a portion of the outer rim of the frame while flanges 36 and 37 are associated with the inner rim and is representative of additional mounting sockets provided thereon. Therefore, it can be seen that the plurality of mounting sockets defined by respective flanges on the outer rim are in alignment with the plurality of mounting sockets carried on the inner rim and that the respective plurality of mounting sockets are respectively arranged on the various corners of the octagon geometric configuration for both the inner and outer rims of the frame. It is also to be understood that the alignment of the mounting sockets also resides along an axis intended to be occupied by adjacent edges of respective reflector panels or sections. By this means, the multiplicity of panels may be readily aligned with respect to one another and further aligned with the mounting sockets for attachment to the frame. Thus, the double brackets or flanges allow the reflector dish to be installed together on the frame while the frame is in upright position. Such a practice is counter to the conventional procedure of having to install the multiplicity of panels on the frame in an upside down orientation.

Figure 4:
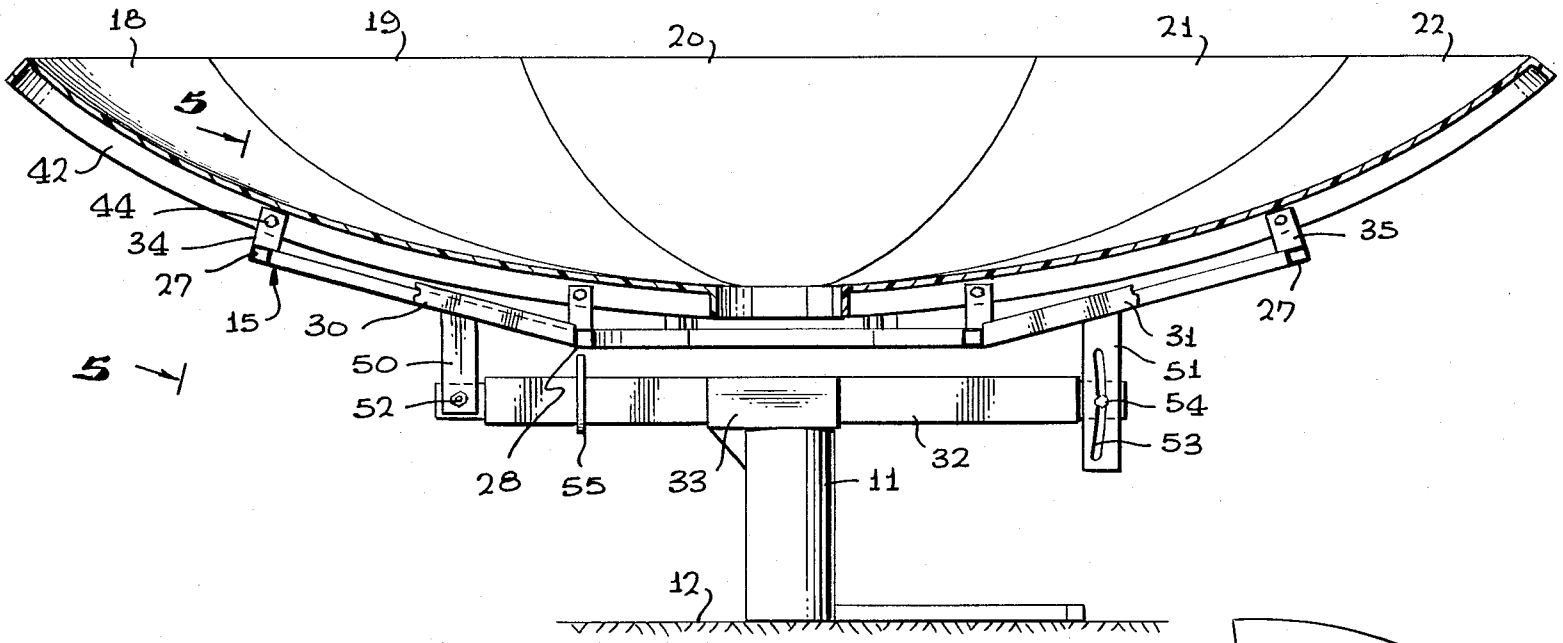
FIG. 4 is a transverse cross-sectional view of the portable antenna as shown in FIG. 3 as taken in the direction of arrows 4—4 thereof.
Figure 6:
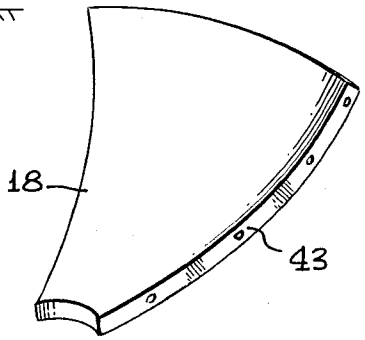
FIG. 6 is a perspective view of a single panel or section used in the dish or reflector of the antenna.

Referring now in detail to FIG. 4, it can be seen that each of the panels, such as panel 18 which is identical to the panel 24 and the others in the panel array, include downwardly depending flanges along the periphery or edge marginal region thereof. In FIG. 6, a side or edge flange is indicated by numeral 43 for the panel 18. It is to be understood that all of the other panels or reflector sections include similar flanges so that when the panels or sections are placed side-by-side the edge flanges will engage with one another and be insertably received into a mounting socket.

Figure 5:
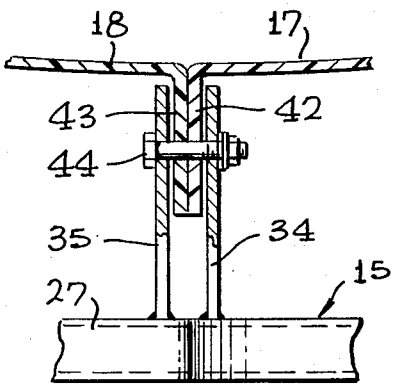
FIG. 5 is an enlarged cross-sectional view of a mounting joint for joining the antenna dish sections to the frame.

Such an arrangement of mounting is shown more clearly in FIG. 5 wherein the flanges 42 and 43 associated with panels or sections 17 and 18 are introduced into the space defined between the opposing surfaces of flanges 34 and 35 which define the mounting socket. Secure fastening is achieved by placement of fastener 44 into place. Although bolt and nut fastener 44 is illustrated, other types of fastening may be employed if desired.

Referring to FIG. 4, the frame 15 is carried on the cross bar 32 by means of brackets 50 and 51 which are respectively attached at their opposite ends to the frame 15 and the ends of the bar 32. For adjustment purposes, the end of bracket 50 is attached to the cross bar 32 by means of a pivot connection 52 while bracket 51 includes an arcuate slot 53 into which a pin 54 slidably projects. Therefore, the frame including the reflector dish 13 may be pivoted about pin 52 within the limits of engagement pin 54 with the opposite ends of the slot 53. A plate 55 is fixedly carried on the cross bar 32 and is employed as a stop for limiting movement of the frame 15 with respect to the cross bar 32.

In view of the foregoing, it can be seen that the novel construction of the portable antenna 10 provides for each assembly and disassembly by unskilled persons using ordinary tools. After the pedestal and frame have been position on the ground surface 12, the respective panels of the reflector are placed onto the frame so that adjacent edge flanges of each panel fall within the mounting sockets on the frame. In this manner, the double brackets or mounting sockets permit the various panels of the reflector dish to be bolted together on the frame while the frame is in an upright position on the pedestal 11. This completely avoids the prior practice of assembling the dish onto the frame in an upside down orientation.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A portable antenna assembly comprising the combination of:

a base;

a frame having inner and outer rims joined by braces;

an adjustment means movably coupling one side of said frame to said base;

a plurality of mounting sockets carried on said frame in fixed spaced relationship about said inner and outer rims of said frame opening outwardly from the side of said frame opposite to its side coupled to said base;

a dish-like reflector composed of a plurality of wedge-shaped panels arranged in coaxial relationship with said frame;

each of said wedge-shaped panels having edge marginal regions providing peripheral flanges next to peripheral flanges of adjacent wedge-shaped panels engaging for insertable reception into said mounting sockets to provide a unity construction;

fastener means secure said flanges to said mounting sockets;

each of said mounting sockets comprise a pair of spaced apart flanges having opposing surfaces defining a receptacle for insertably receiving and retaining a pair of adjacent panel flanges;

said frame rims constitute a pair of octagon rims coaxially disposed with respect to said reflector and each of said mounting sockets of said plurality disposed at each corner of said octagon inner and outer rims; and said panels are assembled with said frame from the side of the frame opposite to its side coupled to said base whereby said panels are assembled from one frame side only in an upright position.

* * * * *